US009174407B2

(12) United States Patent
Herrin

(10) Patent No.: US 9,174,407 B2
(45) Date of Patent: Nov. 3, 2015

(54) TRAY FORMING APPARATUS

(71) Applicant: Rock-Tenn Shared Services, LLC, Norcross, GA (US)

(72) Inventor: Robert M. Herrin, Orlando, FL (US)

(73) Assignee: WestRock Shared Services, LLC, Norcross, GA (US)

( * ) Notice: Subject to any disclaimer, the term of this patent is extended or adjusted under 35 U.S.C. 154(b) by 450 days.

(21) Appl. No.: 13/761,007

(22) Filed: Feb. 6, 2013

(65) Prior Publication Data

US 2013/0150223 A1 Jun. 13, 2013

Related U.S. Application Data

(63) Continuation of application No. 13/451,279, filed on Apr. 19, 2012, now Pat. No. 8,388,507, which is a continuation of application No. 10/721,962, filed on Nov. 25, 2003, now Pat. No. 8,177,699.

(60) Provisional application No. 60/429,319, filed on Nov. 26, 2002.

(51) Int. Cl.

| | |
|---|---|
| ***B31B 1/44*** | (2006.01) |
| ***B31B 1/26*** | (2006.01) |
| ***B31B 3/44*** | (2006.01) |
| ***B31B 3/46*** | (2006.01) |
| ***B65D 5/00*** | (2006.01) |
| ***B31B 1/00*** | (2006.01) |
| *B31B 1/52* | (2006.01) |
| *B31B 1/46* | (2006.01) |

(52) U.S. Cl.

CPC ... *B31B 1/26* (2013.01); *B31B 1/00* (2013.01); *B31B 1/44* (2013.01); *B31B 3/44* (2013.01); *B31B 3/46* (2013.01); *B65D 5/0045* (2013.01); *B31B 1/46* (2013.01); *B31B 1/52* (2013.01); *B31B 2201/267* (2013.01); *B31B 2201/2666* (2013.01); *B31B 2201/28* (2013.01); *B31B 2201/283* (2013.01); *B31B 2201/6091* (2013.01); *B31B 2203/003* (2013.01); *B31B 2203/084* (2013.01)

(58) Field of Classification Search

IPC ..... B31B 1/26,1/44, 1/46, 1/52, 3/44, 3/46, B31B 3/52, 2201/2666, 2201/267, 2203/084

See application file for complete search history.

(56) References Cited

U.S. PATENT DOCUMENTS

| | | | |
|---|---|---|---|
| 2,665,836 | A | 1/1954 | Rendall |
| 3,978,774 | A | 9/1976 | Royal |
| 4,174,658 | A | 11/1979 | Graham |
| 4,256,025 | A | 3/1981 | Goda et al. |
| 4,283,190 | A | 8/1981 | Williams et al. |
| 4,289,491 | A | 9/1981 | Collura et al. |
| 4,345,905 | A | 8/1982 | Moen |
| 4,418,863 | A | 12/1983 | Kimbrell, Sr. |
| 4,460,349 | A | 7/1984 | Charron |
| 4,500,306 | A | 2/1985 | Nowacki |

(Continued)

*Primary Examiner* — Christopher Harmon

(74) *Attorney, Agent, or Firm* — Armstrong Teasdale LLP

(57) ABSTRACT

A tray forming apparatus forms a blank into a tray having a double glued side wall construction for providing a desirable strength to the tray. A platen drives the blank through a forming rails which fold the blank into a partially formed tray having bottom, end and side walls, and inside corner supports formed about the platen. The platen is retracted prior to folding arms further extended portions of the partially formed tray. A compression plate and the folding arms are biased against adhesive portions of the tray for forming a fully formed tray having a double glued side wall construction.

22 Claims, 10 Drawing Sheets

(56) References Cited

U.S. PATENT DOCUMENTS

| | | | | |
|---|---|---|---|---|
| 4,578,054 | A | | 3/1986 | Herrin |
| 4,651,501 | A | | 3/1987 | Matsuda et al. |
| 4,835,944 | A | | 6/1989 | Herrin |
| 4,936,815 | A | | 6/1990 | Kirkland et al. |
| 4,988,331 | A | | 1/1991 | Boisseau |
| 5,024,641 | A | | 6/1991 | Boisseau |
| 5,131,208 | A | | 7/1992 | Paul et al. |
| 5,452,844 | A | | 9/1995 | Bochet et al. |
| 5,656,006 | A | * | 8/1997 | East et al. ..... 493/171 |
| 5,782,732 | A | | 7/1998 | Herrin |
| 5,797,716 | A | | 8/1998 | Herrin |
| 5,807,223 | A | | 9/1998 | Holton |
| 5,853,120 | A | | 12/1998 | McLeod et al. |
| 5,916,078 | A | | 6/1999 | Herrin |
| 5,971,906 | A | | 10/1999 | Tharpe, Jr. et al. |
| 5,979,746 | A | | 11/1999 | McLeod et al. |
| 6,226,965 | B1 | | 5/2001 | Lam |
| 6,306,070 | B1 | | 10/2001 | Herrin |
| 6,422,802 | B1 | | 7/2002 | Herrin |
| 6,622,461 | B2 | | 9/2003 | Gambetti |
| 7,470,225 | B2 | | 12/2008 | Herrin |
| 7,470,226 | B1 | | 12/2008 | Herrin |
| 7,993,255 | B1 | | 8/2011 | Herrin |

* cited by examiner

FIG. 3
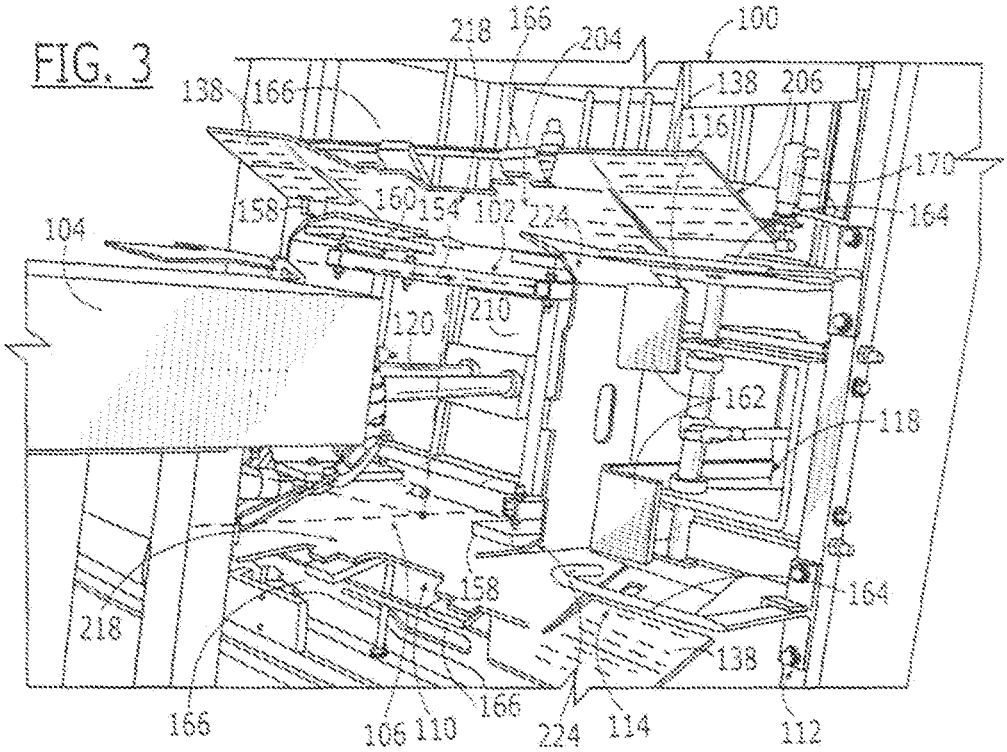
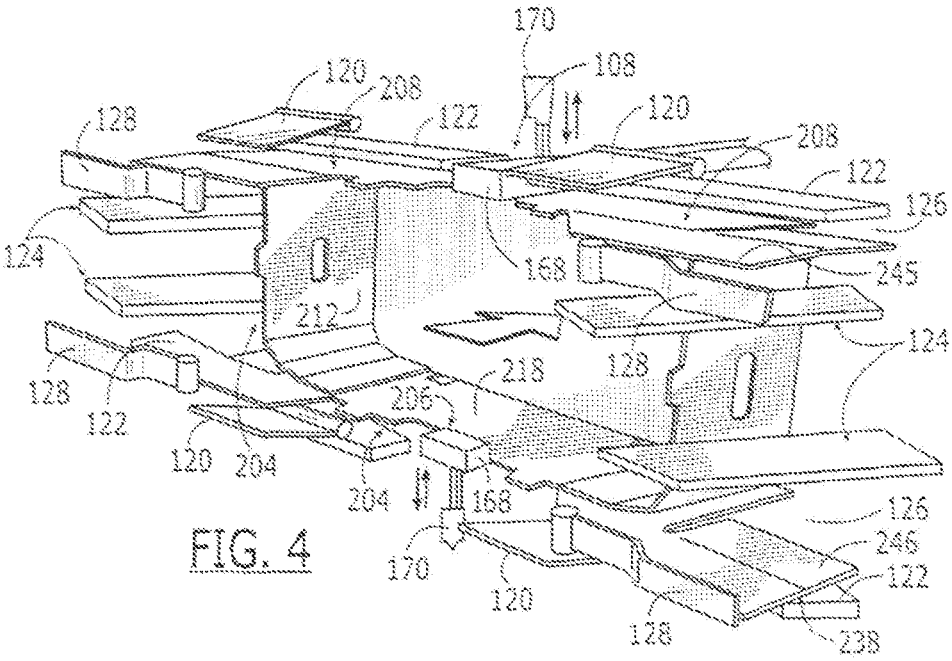
FIG. 4

TRAY FORMING APPARATUS

CROSS REFERENCE TO RELATED APPLICATIONS

This application is a continuation application of U.S. patent application Ser. No. 13/451,279, filed Apr. 19, 2012, entitled "TRAY FORMING APPARATUS", which is a continuation application of U.S. patent application Ser. No. 10/721,962, filed Nov. 25, 2003, entitled "TRAY FORMING APPARATUS" and U.S. Provisional Patent Application No. 60/429,319, filed Nov. 26, 2002 entitled "TRAY FORMING APPARATUS AND METHOD OF FORMING A DOUBLE GLUED CORNER TRAY STRUCTURE" which are all hereby incorporated by reference in their entirety.

FIELD OF THE INVENTION

The present invention generally relates to container fabrication systems, and in particular to a container forming apparatus and automated method of forming a container having a reinforced corner construction from a scored blank.

BACKGROUND OF THE INVENTION

It is well known in the art to use paperboard trays for stacking during delivery to a final destination such as a grocery store and for displaying products such as citrus within the tray as describe in U.S. Pat. No. 5,971,906 for a Tray Forming Apparatus and Method. Such trays are typically formed from a single blank which has been suitably cut, scored and perforated to be folded into a completed tray or container for subsequent filling of product and shipping. There remains a demand in the industry to strengthen the tray to overcome damage during stacking and delivery when carrying product, to reduce the time necessary to fabricate the tray, and as a result the associated costs.

By way of example, in an effort to strengthen such trays formed from a blank, a reinforced corner construction has been developed and is described in U.S. Pat. Nos. 5,853,120 and 5,979,746 to McLoud et al. which describe a container tray having corner reinforcing structures formed from a flat blank. While it is understood that reinforcing corners using multiple flaps or folds within the blank is desirable, it is also time consuming to fabricate such a structure. There remains a need to automatically form containers from flat blanks.

SUMMARY OF THE INVENTION

The present invention is directed to an apparatus and method for forming a blank into a tray having a reinforced corner construction. One embodiment of the apparatus may include a platen dimensioned for biasing against a blank and a platen drive for moving the platen between a first position proximate and in spaced relation to the blank and a second position through a biasing of the platen against the blank and a driving the blank downstream. A forming rail may be positioned downstream the first position for receiving the blank moving thereby and folding portions of the blank with a proximal portion of the forming rail partially folding peripheral portions of the blank and a distal portion of the forming rail securing the blank into a partially formed tray. A first folding arm is movably positioned for biasing against an extended portion of the partially formed tray. A compression plate is movably carried in spaced relation to the partially formed tray and a fixed plate may be carried in spaced relation to the compression plate so as to form a passage. A second folding arm is movably positioned for biasing against the extended portion of the partially formed tray and for folding the extended portion through the passage, with the first and second folding arms and the compression plate biased against the fully folded tray to cause an adhesion of corner portions of the tray and thus a fully formed tray having a double glued side wall construction.

A method aspect of the invention may include providing a blank having portions thereof for forming a bottom panel, first and second opposing end panels, first and second opposing side panels, wherein each of the opposing end panels has an inside corner support member attached to opposing edges of each of the opposing end panels, each of the opposing side panels having a top wall portion attached thereto, and wherein an outside corner support member is attached to the top wall portion, the outside corner support member having an outside corner support and a side fold portion thereof for forming the blank into a tray having a double glued wall construction. The method may include biasing a platen against the bottom panel for moving the blank downstream through a forming rail positioned for folding the end panels and the side panels, wherein each inside corner support member is folded inwardly of the opposing side panels, further advancing the platen downstream and to a tray forming position, wherein a distal portion of the forming rail secures the blank into a partially formed tray. The partially formed tray may be configured with the end and side panels positioned generally orthogonal to the bottom panel and each of the inside corner support members are folded and in juxtaposition with the side panel portions, and wherein each of the top wall portions and outside corner support members are generally parallel to respective side panels. The platen is retracted from the tray forming position. A first folding arm may be biased against the top wall portion for folding the top wall portion to a position generally parallel to the bottom panel. The side fold portion may be partially folded by contacting a compression plate. A second folding arm may then be biased against each of the end fold portions for folding them into contact with the end wall. The compression plate is then biased against each of the side fold portions for forming a fully formed tray.

An adhesive may be applied to a surface of the blank along each of the outside corner members and portions of the side panels proximate prior to moving the blank into the forming position. Alternatively, adhesive may be supplied with the blank.

BRIEF DESCRIPTION OF THE DRAWINGS

A preferred embodiment of the invention, as well as alternate embodiments are described by way of example with reference to the accompanying drawings in which:

FIG. 3 is a partial front right perspective view of the apparatus of FIG. 1;

FIG. 4 is a partial top perspective view illustrating a partially formed tray positioned for folding elements thereof using associated folding elements of the apparatus of FIG. 1;

DETAILED DESCRIPTION OF THE PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, the embodiments herein presented are provided so that this disclosure will be thorough and complete, and will fully convey the scope of the invention to those skilled in the art.

Figure 1:
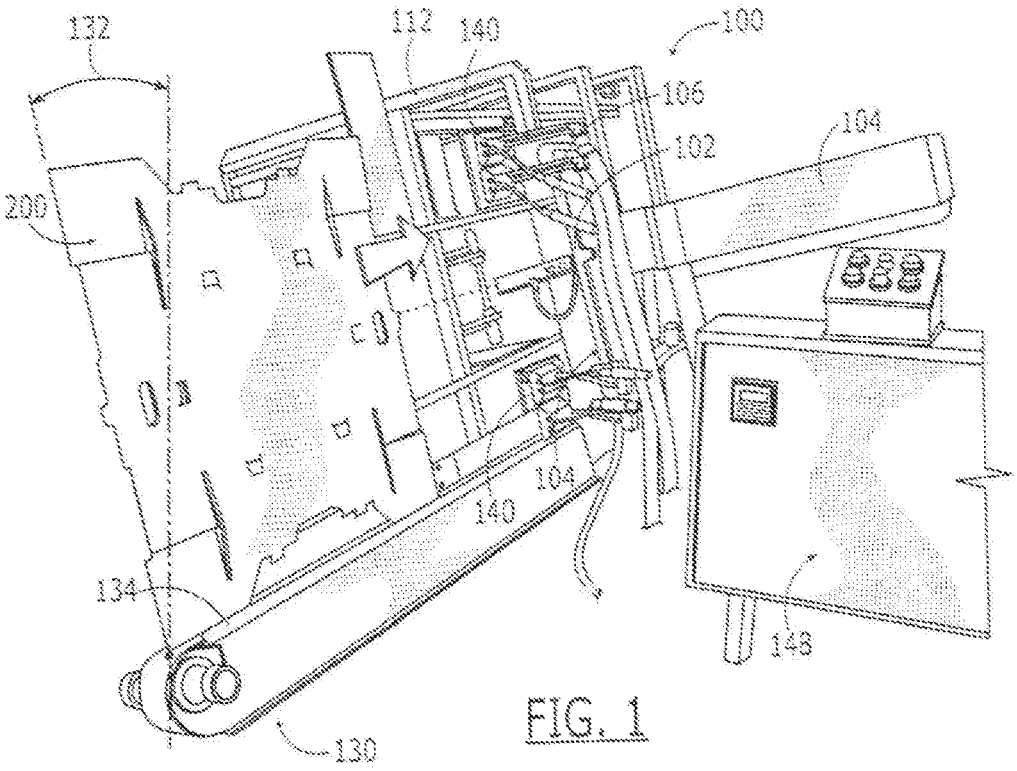
FIG. 1 is a partial front left perspective view of one tray forming apparatus in keep with the teachings of the present invention.
Figure 2:
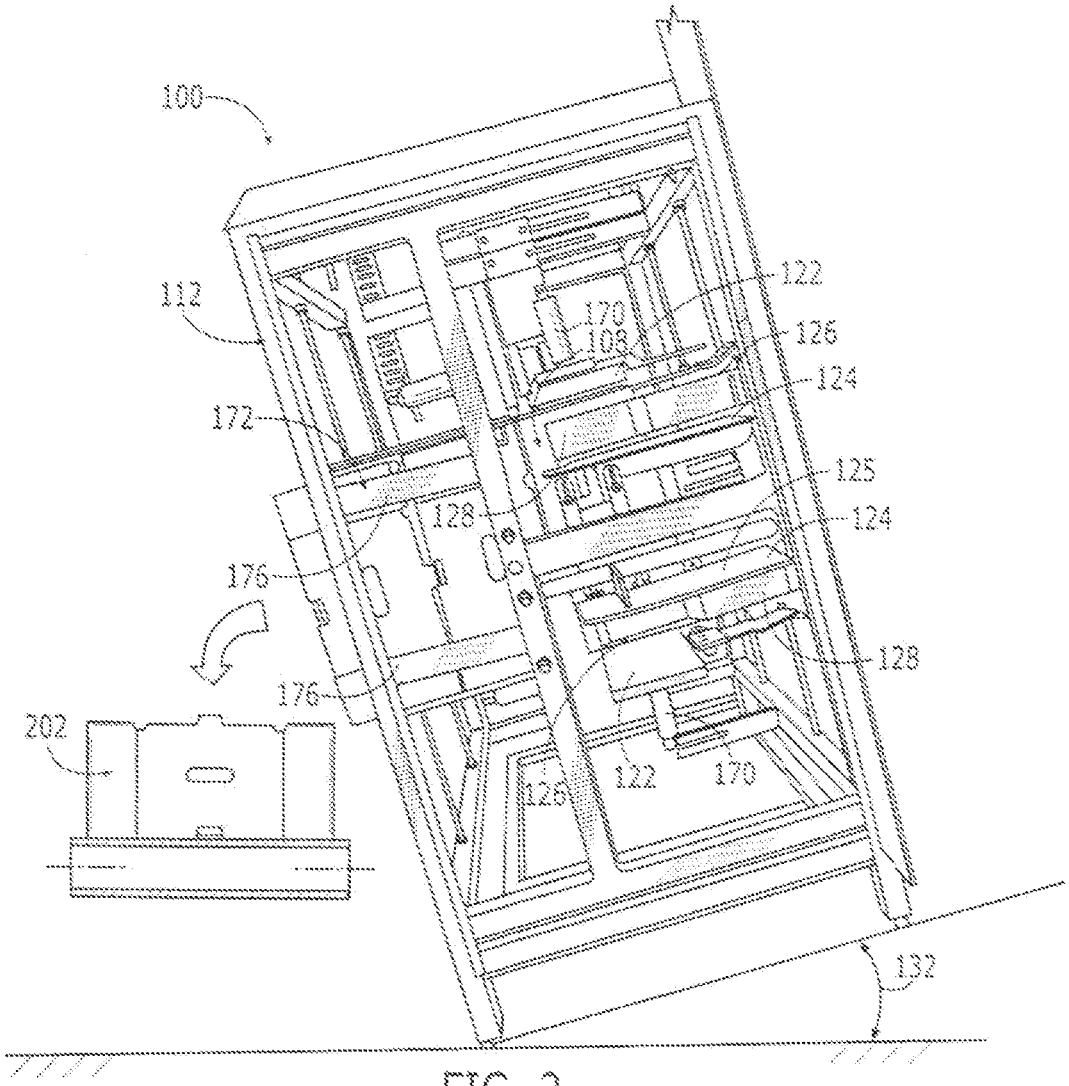
FIG. 2 is a partial side elevation view of the apparatus of FIG. 1.

By way of example, and with reference initially to FIGS. 1 and 2, one embodiment of the present invention includes a tray forming apparatus 100 for forming a blank 200 into a fully formed tray 202. The apparatus 100 may further be described to include a platen 102 dimensioned for biasing against the blank 200 using a platen drive 104 operable for moving the platen between a first position 104 proximate and in spaced relation to the blank 200 and a second position 108, illustrated with reference again to FIG. 2, through an initial movement and biasing of the platen against the blank for driving the blank downstream the first position, as illustrated with reference to FIG. 3. As illustrated with continued reference to FIG. 1, a frame 112 carried the drive 104 as well as other forming elements and operable devices of the apparatus 100 later described in this section.

Figure 5:
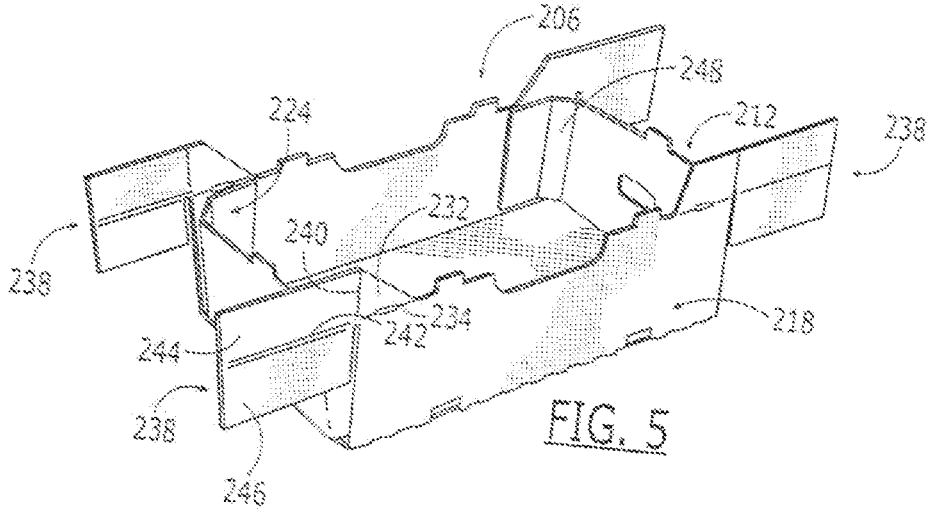
FIG. 5 is a top perspective view of the partially formed tray of FIG. 4.

With continued reference to FIG. 3, a forming rail 114 is positioned downstream the first position 106 for receiving the blank 200 and folding peripheral portions 204 thereof, wherein a proximal portion 116 of the forming rail partially folds the peripheral portions 204 of the blank and a distal portion 118 of the forming rail secures the blank as a partially formed tray 206, illustrated with reference to FIGS. 4 and 5, to be further detailed later in this section. With continued reference to FIG. 4, a first folding arm 120 is pivotally carried by the frame 112 and positioned for biasing against an extended portion 208 of the partially formed tray 206 for a folding thereof, the first folding arm 120 being positioned proximate and downstream the distal portion 118 of the forming rail 114, as illustrated with reference again to FIG. 3. A compression plate 122 is pivotally carried by the frame 112 and in a spaced relation to the partially formed tray 206. A fixed plate 124 is carried in a spaced relation to the compression plate 122 to form a passage 126, to be further detailed later in this section. A second folding arm 128 is carried by the frame 112 and positioned for pivoting and biasing against the extended portion 208 of the partially formed tray 206 for folding the extended portion through the passage 126.

With reference again to FIG. 1, an in-feed conveyor 130 may be used for conveying the blank 200 to the first position 106. By way of example, one embodiment may include the conveyor 130 placing the blank 200 at an angle 132 to vertical, and thus in a non-vertical orientation for permitting gravity to slidably hold the blank against a surface of the conveyor while conveying the blank on a rotating belt 134. It is to be understood that the apparatus 100 may be operated with the blank entering at a horizontal orientation as well as the angle position herein described.

Figure 6:
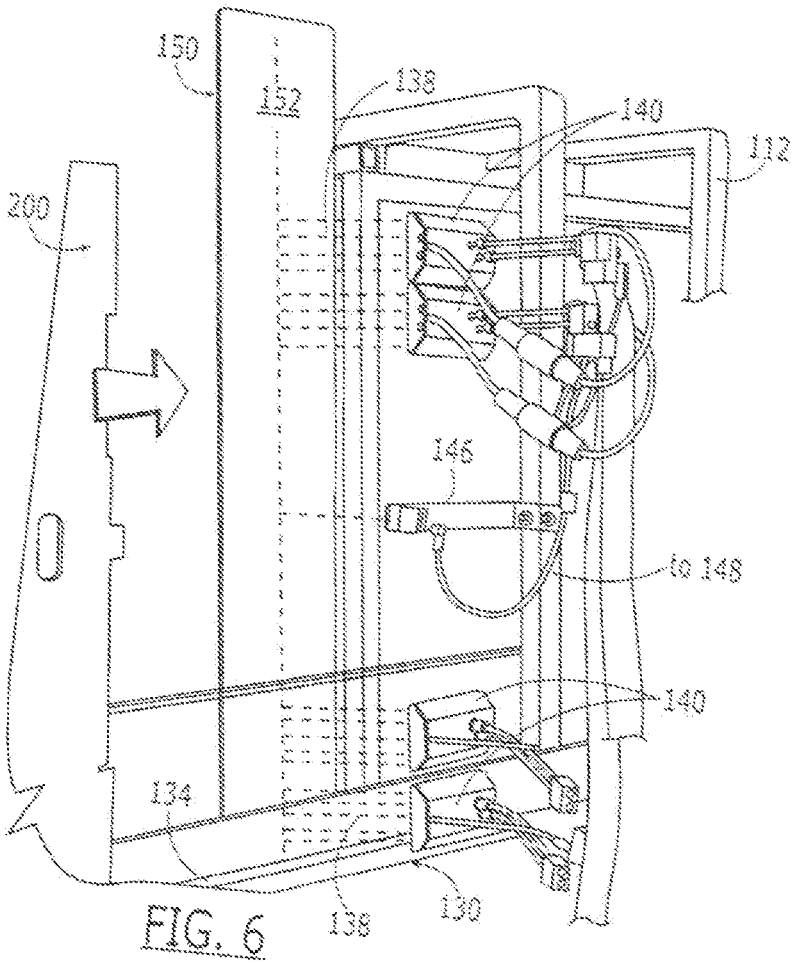
FIG. 6 is a partial enlarged front left perspective view of an adhesive application portion of the apparatus of FIG. 1.

With continued reference to FIG. 1, and to FIG. 6, the apparatus 100 herein described, by way of example, may include a hot glue applicator 136 for applying an adhesive 138 to the blank 200, as illustrated with reference to FIG. 7. In one embodiment, as herein described by way of example, multiple glue heads 140 may adjustably carried by the frame 112 for providing a specific spray pattern at a specific glue head temperature and thus a temperature of the glue for allowing the last surface to be glued to have a soft glue sufficient for making appropriate attachment as the first glued surface during the folding and compressing of the blank to form the tray. A sensor 146 is positioned for sensing a leading and a trailing edge of the blank 200 for providing a signal to a controller 148 for a timely directed allocation activation signal to allow the adhesive 138 to be applied as desired, such as illustrated with reference again to FIG. 7. With reference again to FIG. 6, the glue heads 140 are directed toward a backstop 150 having a roughened surface 152 for receiving any adhesive 138 that may miss hitting the blank 200. The roughened surface 152 allows any adhesive collected thereon to be easily removed when dry. It will be appreciated by those skilled in the art that alternate adhesive methods may be employed, now having the benefit of the teachings of the present invention. By way of example, stapling may be employed in conjunction with the various folding and biasing steps in forming the tray. Yet further, an adhesive may be carried by the blank that is responsive to temperature or pressure for activation. Similarly, various shaped blanks having various constructions may be used to form a container having a desirable shape, now given the teachings of the present invention.

Figure 7:
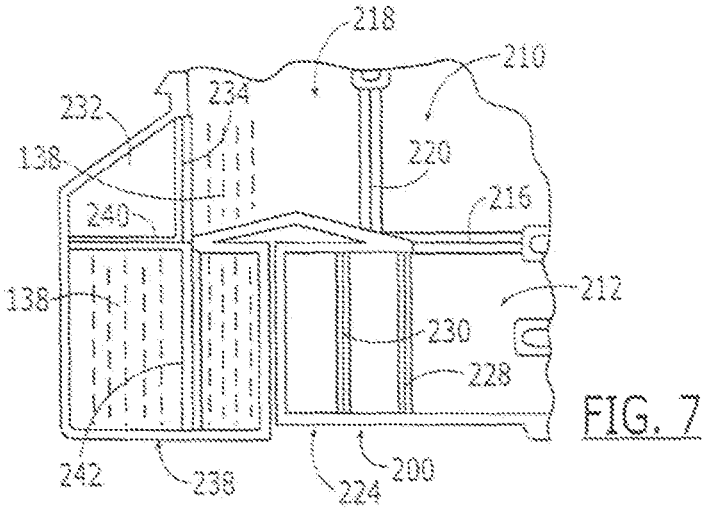
FIG. 7 is a partial plan view of a corner portion of the blank of FIG. 5 illustrating one embodiment of an adhesive applied thereto.
Figure 8:
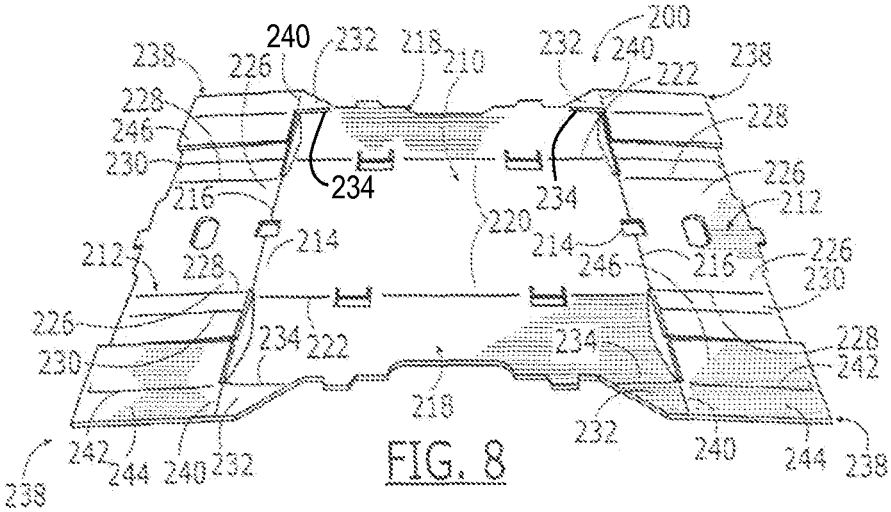
FIG. 8 is a top front perspective view of a paperboard blank having a plurality of fold lines and cuts for forming the blank into a tray through a plurality of folding operations.

To more fully describe aspects of the invention, the paperboard blank 200, as illustrated further with reference to FIG. 8 is herein described by way of example only. The blank 200 may be described to include a bottom panel 210 with first and second opposing end panels 212 formed at opposing peripheral end portions 214 of the bottom panel via first fold lines 216. First and second opposing side panels 218 are connected to opposing peripheral side portions 220 of the bottom panel 210 via second fold lines 222. An inside corner support member 224 is attached to opposing edges 226 of each of the opposing end panels 212 via a third fold line 228. In an optional construction, herein described by way of example, the inside corner support member 224 includes a fourth fold line 230 for forming a bevel within the tray construction. A top wall portion 232 is attached to opposing edges 234 of each opposing side panel 218 via a fifth fold line 236. Further for the blank 200 herein described by way of example, an outside corner support member 238 is attached to each of the top wall portions 232 via a sixth fold line, wherein the outside corner support member 238 includes a seventh fold line 242 for providing an outside corner support via an end fold portion 244 and a side fold portion 246. The above further illustrated with reference again to the single corner portion of FIG. 7.

Now having described the blank 200 more fully, embodiments of the apparatus 100 may be further described through detailed illustration. By way of example, and with reference again to FIG. 7, the platen 102 may comprise a rectangular peripheral portion dimensioned for folding the rectangular shaped bottom panel 210 of the blank 200 into a rectangular shape. In one embodiment of the blank 200, above described, the peripheral portion 154 of the platen 102 includes bevelled corners 156, as illustrated with reference again to FIG. 5, and to FIG. 9 to form the bevel 248 within the inside corner support member 224. The platen 102 is dimensioned and aligned to fit proximate the first and second fold lines 216, 222 when contacting the bottom panel 210. It is to be understood that while the inside corner support member is herein described by way of example as having a bevel portion, alternatively it may have a single fold to form a squared inside corner. It will be further understood that while the corner construction herein described in relation to the end panel and the side panel, the tray may be constructed in a mirror image or with reference to alternative end and side panels forming the tray.

Figure 9:
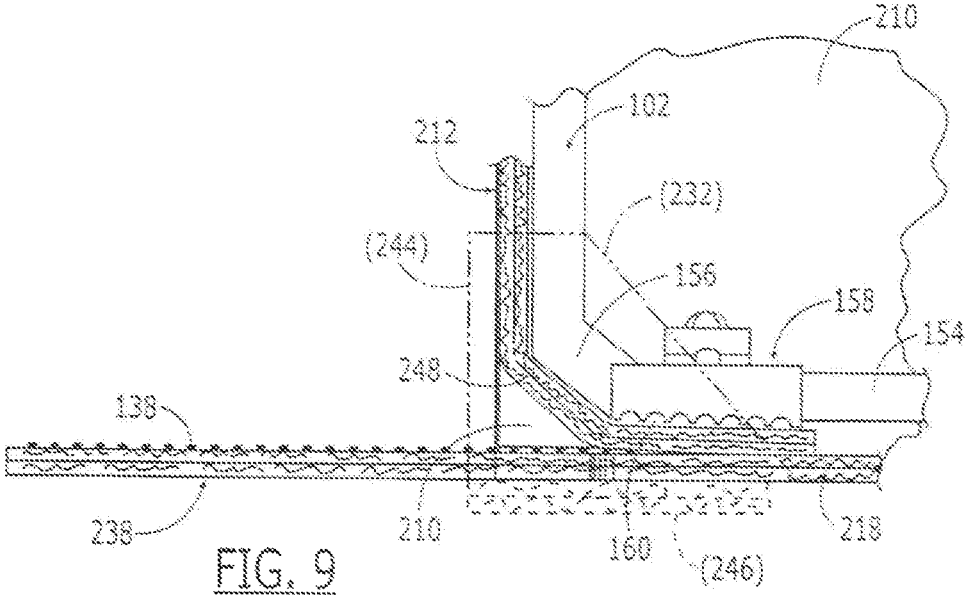
FIG. 9 is a partial top plan view of one corner portion of the partially formed tray of FIG. 5 illustrating one embodiment of a platen used to move the blank downstream through a portion of the tray forming process.

With continued reference to FIGS. 7 and 9, a guide plate 158 is carried by the platen 102 for further defining the platen peripheral portion 154 and for providing a compression surface 160 operable with the inside corner support member 224. The compression surface 160, as herein described by way of example, may comprise depressions for reducing a frictional contacting surface thereof. The corrugations on the compression side of the guide plates reduce the surface area for providing increased pressure on glue points while at the same time reducing friction between the guide plate surface and the tray inside wall to allow the platen to be more easily removed when being retracted, as earlier described.

By way of further example for the tray 202 herein desired, and with reference again to FIG. 3, the inside corner support member 224 is folded to about 90° while the side panel 218 is folded upward approximately 30°-45°. Next the end panel 212 is folded up approximately 90° and the side panel 218 is brought up to a 90° fold compressing the side panel, having the adhesive 138 thereon, against the inside corner support member 224 having the guide plate 158 against it. As a result, the rectangular structure of this sample tray is formed. Each guide plate 158 may includes adjustment screws for aligning the guide plate and positioning the corrugated surface 160 of the guide plate for a desired attitude when compressing varying styled trays. As a result an adjustable platen is provided.

Again using the blank 200, by way of example to more fully describe elements of the embodiment herein presented, reference is again made to FIG. 3 wherein the forming rail 114 may include opposing end folding rails 162 positioned for receiving the end panels 212 and dimensioned for upwardly folding them from the bottom panel 210. Opposing edge rails 164 are positioned for inwardly folding outside edge portions, the inside corner support members 224, herein described by way of example. Opposing side folding rails 166 are positioned for receiving the side panels 218 of the blank 200 and for folding the side panels upwardly from the bottom panel 210 while capturing the inside corner support members 224 therebetween. As earlier described, the blank 200 is received at proximal portions 116 of the forming rail 114, and a distal portion 118 thereof secures the now partially formed tray 206. The forming rail 114 folds the end panels 212 about the first fold lines 216 and the side panels 218 about the second fold lines 222, with each inside corner support member 224 folded about the third fold line 228 inwardly of the opposing side panels 218. The partially formed tray 206 is configured with the end panels 212 and the side panels 218 positioned generally orthogonal to the bottom panel 210 and each of the inside corner support members 224 folded about the third fold line 228 and in juxtaposition with the side panel, as illustrated with reference again to FIGS. 5 and 9. Each of the top wall portions 232 and the outside corner support members 238 are generally parallel to respective side panels 218 thereof.

With reference again to FIG. 4, a locking arm 168 is operable with the folding rail described with reference to FIG. 3 for securing the partially formed tray 206 at the second position 108, herein shown separately for clarity.

Figure 10:
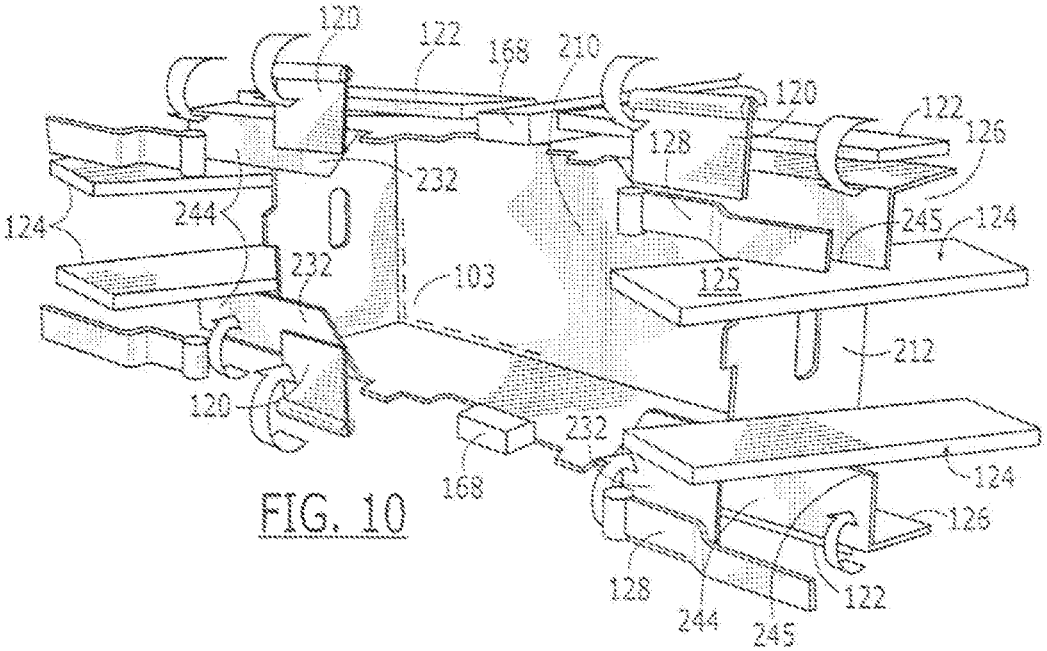
FIG. 10 is a partial perspective view illustrating a first folding arm operable on the partially formed tray.
Figure 11:
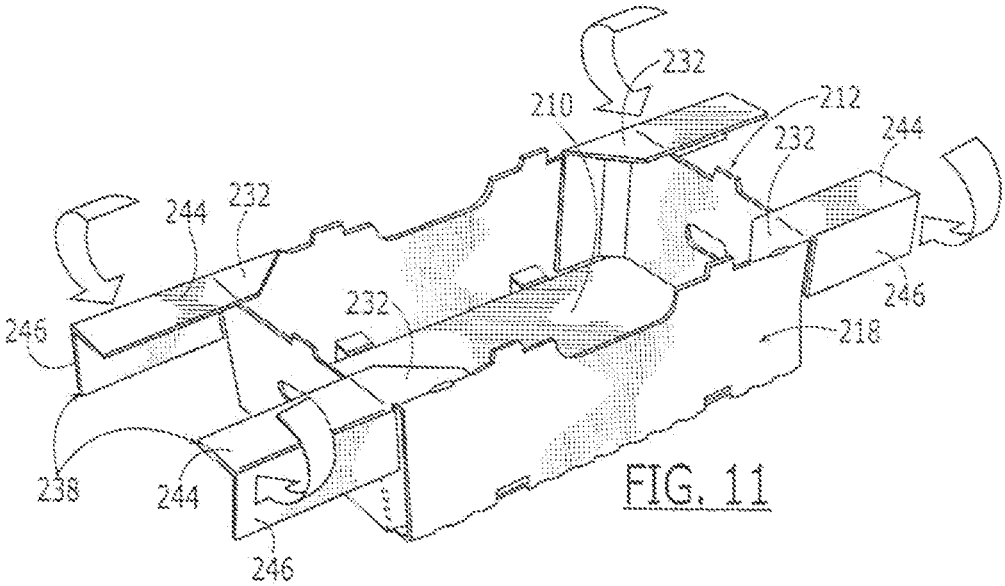
FIG. 11 is a top perspective view of the partially formed tray resulting from the folding process of FIG. 10.

With the partially formed tray 206 secured in the second position 108, as illustrated with reference again to FIG. 4, by way of example, the platen 102 is retracted and the folding of the top wall portions 232 and the outside corner support members 238 commence. With reference again to FIG. 2, and to FIGS. 10 and 11, the first folding arm 120 is operable for folding the top wall portion 232 about the fifth fold line 236 to a position generally parallel to the bottom panel 210. The side fold portion 246 is partially folded about the sixth fold line 240 by passing through the passage 126 formed by the spaced compression plate 122 and the fixed plate 124. As earlier described, the compression plates 122 are moveable for biasing against each of the side fold portions 246. A squared inside corner is illustrated by way of example in FIG. 10, wherein a squared corner platen 103 would be employed.

For the double-glued corner construction, herein described, the partial folding of the side fold portion 246 has been shown to improve on the performance and speed in the forming process. The fixed plate 124 allows the outside corner support member 238 to stay oriented relative to a plane of the top wall portion 232 resulting in a "squared off" corner construction with vertical walls providing a desired strength needed during stacking of filled trays. By way of example, damage to fruit is avoided especially for the lower trays in the stack. It is to be understood that while the compression plate as herein described is used for both a guide plate to form the passage and a compression plate during movement thereof, alternatively a separate compression plate may be used in conjunction with a separate passage.

Figure 12:
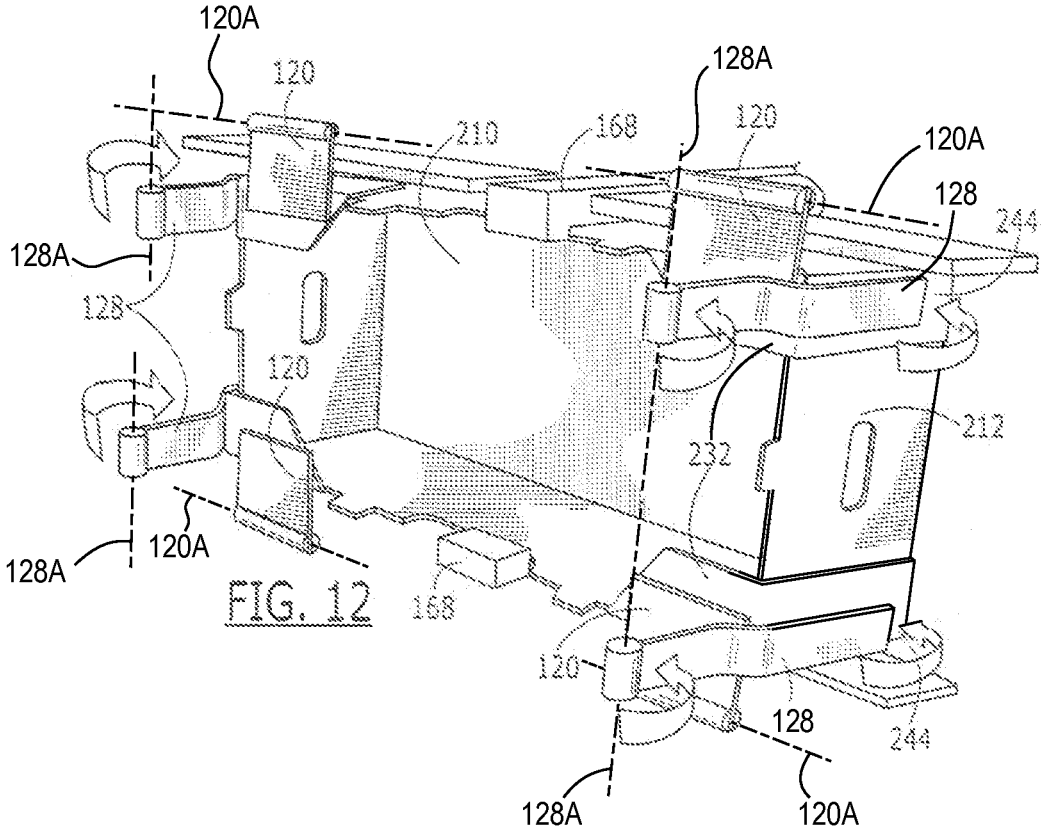
FIG. 12 is a partial top perspective view illustrating elements of the apparatus of FIG. 1 securing a fully formed tray therein.
Figure 13:
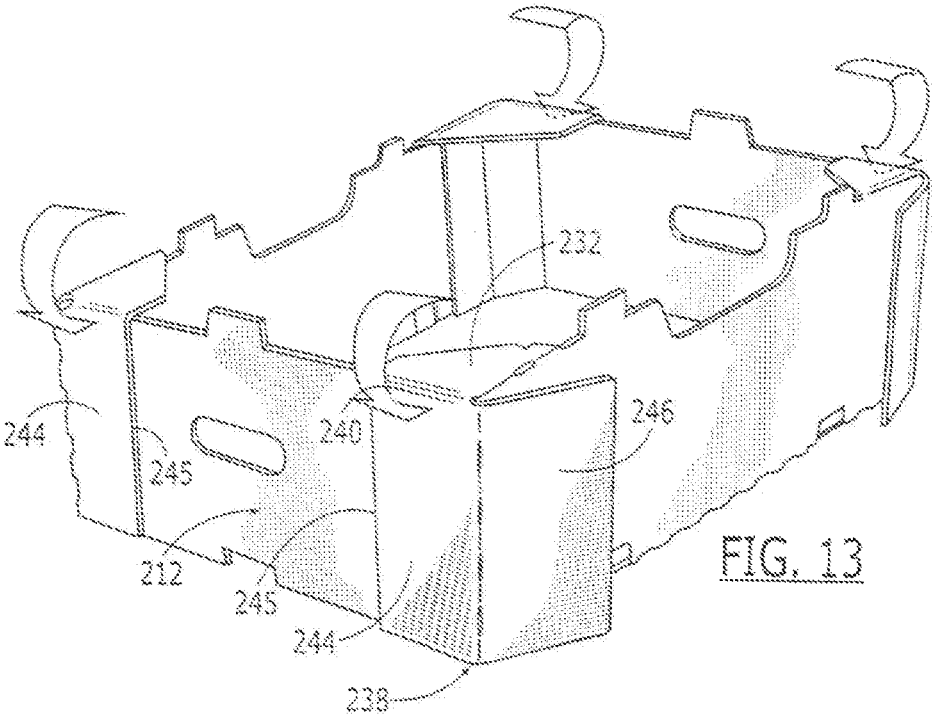
FIG. 13 is a top perspective view of the partially formed tray resulting from the folding process of FIG. 12.
Figure 14:
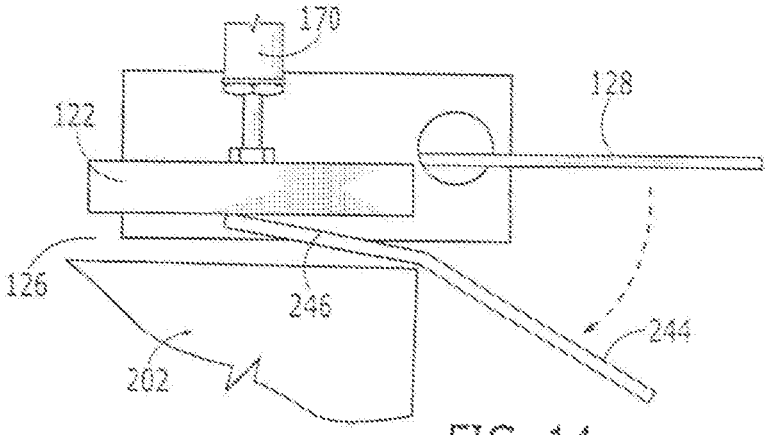
FIG. 14 is a partial perspective view illustrating a first folding arm operable on the partially formed tray.
Figure 15:
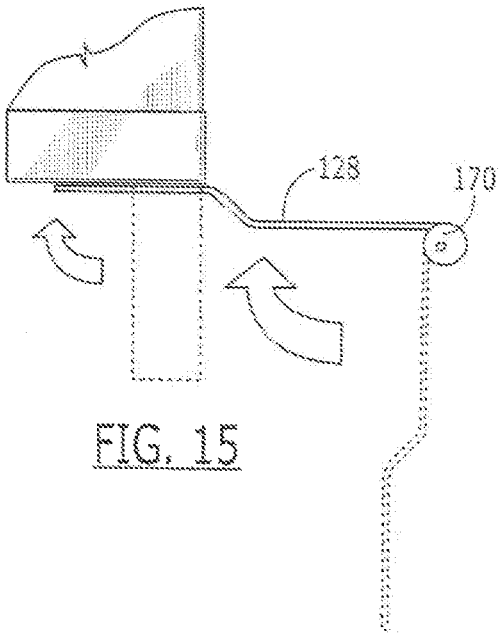
FIG. 15 is a partial perspective view illustrating a second folding arm operable on the partially formed tray.
Figure 16:
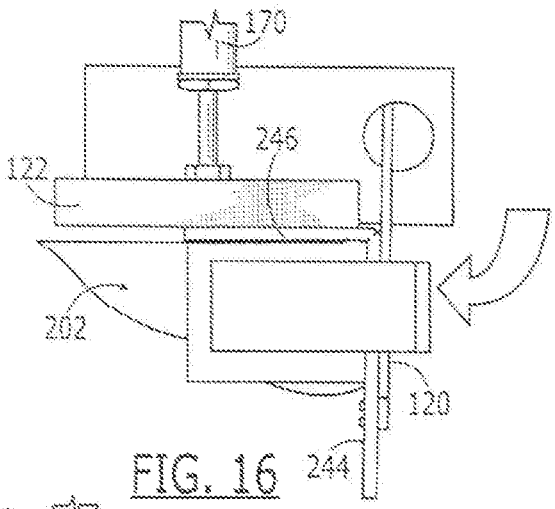
FIG. 16 is a partial end view illustrating an orientation of a compression plate and a first folding arm prior to a folding movement thereby.
Figure 17:
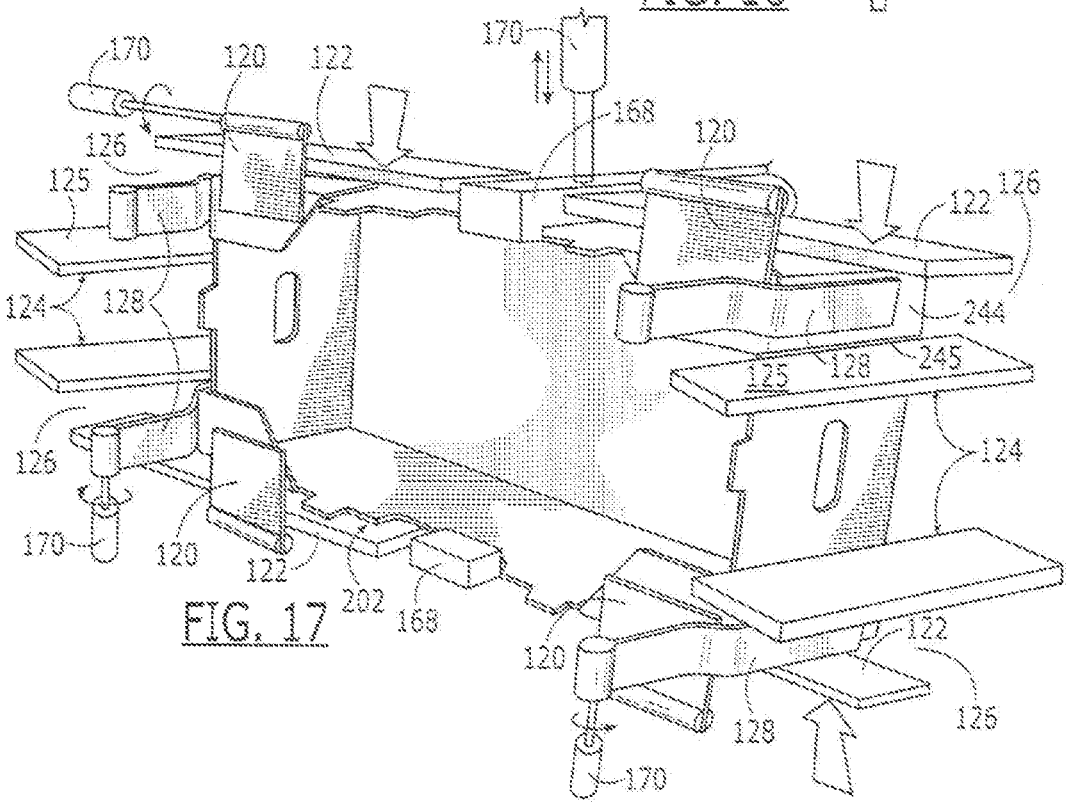
FIG. 17 is a partial perspective view illustrating an orientation of the compression plate, the first folding arm and the second folding arm is a compression orientation for holding corner portions of a fully formed tray.
Figure 18:
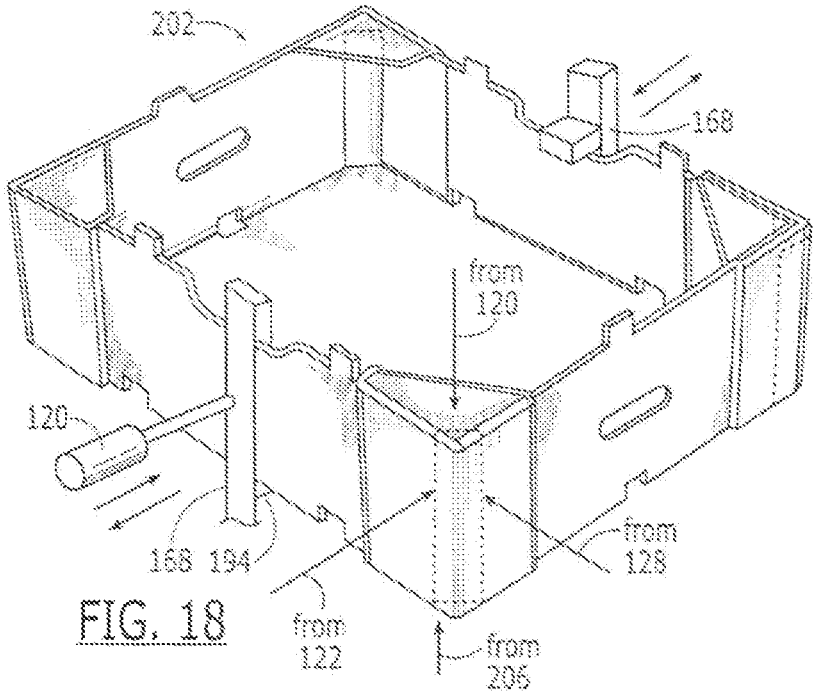
FIG. 18 is a top front perspective view of a fully formed tray formed by the apparatus of FIGS. 1-3.
Figure 19:
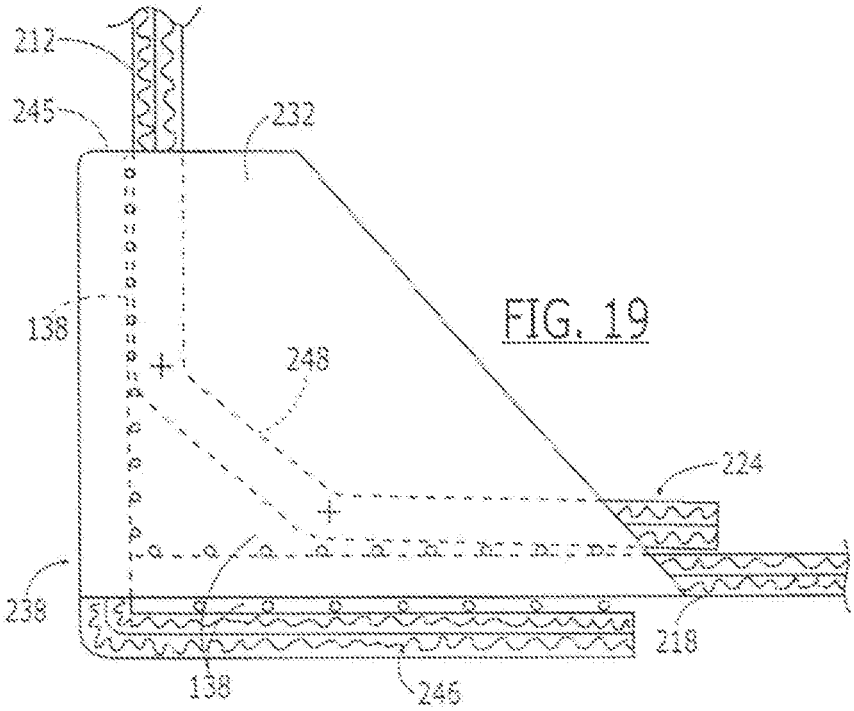
FIG. 19 is a partial enlarged top plan view of one corner portion of the fully formed tray of FIG. 18.

With reference to FIGS. 12-15, a forming of the outside corner support members 238 commences with the second folding arm 128 rotated against the end fold portions 244, folding them about the sixth fold lines 240, and biasing the end fold portions against the end panels 212. With reference to FIG. 12, by way of example, the second folding arm 128 includes an axis of rotation 128A generally perpendicular to an axis of rotation 120A of the first folding arm 120. As illustrated with continued reference to FIG. 12, by way of example, an edge 245 of the end fold portion 244 is guided onto the end panel 212 along a surface 125 of the fixed plate 124 for orienting the end fold portion 244 in a preferred orthogonal relation to the bottom panel 210 for enhancing the load bearing strength of the tray 202, as earlier described. A final compression phase includes the compression plate 122 folding of the partially folded side fold portion 246 and compressing thereof as illustrated with reference to FIGS. 16-18. Compression forces act upon each corner of the fully formed tray 202 with the compression plate, the first and second folding arms, and the locking arm each providing opposing forces to compress the adhesive against respective tray surfaces, as further illustrated with reference to FIG. 19 including a partial top view of the double glued wall construction. As will be understood by those skilled in the art, the controller 148 earlier described with reference to FIG. 1 is operable with drive devices 170, as illustrated with reference again to FIGS. 2 and 3, for each of the platen 102, the compression plate 122, the first folding arm 120, the second folding arm 128, and the locking arm 168 for a timely movement for each of these element to contribute to the folding of the blank 200 into the partially formed tray 206, and into the fully formed tray 202, as herein described. With such, the fully formed tray 202 may be released from the frame 112. As illustrated with reference again to FIG. 2, a glue-setting phase may be provided as herein described, by way of example, with reference to a magazine styled frame 172 which receives the fully formed tray 202 stops 174, such as that of the locking arm 168 are released to permit a subsequent tray being formed to push the fully formed and glued tray into the magazine styled frame 172. The magazine styled frame 172 includes framing elements 176 that form an aperture for receiving the tray having an increased outside dimension as a result of the folded corner construction.

As illustrated with reference again to FIG. 2, the apparatus 100 herein described by way of example, carries three trays within the apparatus with a first tray in the forming and compression phase, a second tray being held in the magazine styled frame section for glue setting, and a third tray ready to be ejected when a fourth blank is pushed into position for forming into the partially formed tray.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the claims herein presented.

That which is claimed is:

1. A machine for forming a container from a blank of sheet material, the blank including at least one bottom panel, two opposing side panels, two opposing end panels, and an outside corner support member, the machine comprising:

a platen for moving the blank from a first position to a second position downstream therefrom;

a first folding arm movably positioned for folding at least a portion of the outside corner support member to form the blank into a partially formed container;

at least one compression member carried in spaced relation to the partially formed container;

a fixed plate carried in spaced relation to the at least one compression member, the fixed plate and the at least one compression member forming a passage therebetween; and a second folding arm positioned for biasing against the outside corner support member, wherein the fixed plate is positioned for contacting an outer edge of the outside corner support member and guiding at least a portion of the outside corner support member through the passage to a position where the outer edge of the outside corner support member is substantially perpendicular to the at least one bottom panel of the container.

2. A machine according to claim 1, wherein the outside corner support member includes at least a top wall portion, an end fold portion, and a side fold portion.

3. A machine according to claim 2, wherein the first folding arm is configured to fold at least the top wall portion of the outside corner support member to a position that is substantially parallel to the at least one bottom panel.

4. A machine according to claim 2, wherein the first folding arm is configured to fold the top wall portion and the end fold portion of the outside corner support member to a position that is substantially parallel to the at least one bottom panel.

5. A machine according to claim 2, wherein the second folding arm is movable along the passage and is configured to fold the end fold portion along with the side fold portion of the outside corner support member through the passage to a position that is substantially perpendicular to the at least one bottom panel, wherein the end fold portion is folded about a fold line extending between the end fold portion and the top wall portion.

6. A machine according to claim 2, wherein the side fold portion is configured to be at least partially folded towards the end fold portion within the passage.

7. A machine according to claim 2, wherein the fixed plate is positioned to contact an outer edge of at least one of the end fold portion and the side fold portion, and guide at least one of the end fold portion and the side fold portion through the passage to a position substantially perpendicular to the at least one bottom panel of the container.

8. A machine according to claim 2, wherein the fixed plate is positioned to contact an outer edge of the end fold portion of the outside corner support member, and guide the end fold portion along a surface of the fixed plate to a position where the outer edge is substantially perpendicular to the at least one bottom panel of the container.

9. A machine according to claim 2, wherein the top wall portion of the outside corner support member extends between the two opposing side panels or between the two opposing end panels.

10. A machine according to claim 2, wherein the fixed plate is positioned to contact an outer edge of the end fold portion of the outside corner support member, and guide the end fold portion along a surface of the fixed plate to a position adjacent one of the opposing end panels such that the end fold portion and the end panel form an end wall.

11. A machine according to claim 2, wherein the side fold portion is positioned adjacent one of the opposing side panels such that the side fold portion and the side panel form a side wall.

12. A machine according to claim 1 further comprising a forming rail positioned downstream the first position for receiving the blank moving against the forming rail for folding portions of the blank, wherein the forming rail at least partially folds the opposing side panels and end panels, and secures the blank into a partially formed container.

13. A machine according to claim 1, wherein the second folding arm is movable along the passage and is positioned to fold at least a portion of the outside corner support member along the passage to a position that is substantially perpendicular to the at least one bottom panel.

14. A machine according to claim 1, wherein the second folding arm and the fixed plate work in combination to position the outside corner support member resulting in a squared-off corner structure.

15. A machine according to claim 1, wherein the second folding arm, the fixed plate, and the compression member work in combination to position the outside corner support member resulting in a squared-off corner structure.

16. A machine for forming a container from a blank of sheet material, the blank including at least one bottom panel, two sets of opposing side panels, and an outside corner support member, the machine comprising:

a platen for moving the blank from a first position to a second position downstream therefrom;

a first folding arm movably positioned for folding at least a portion of the outside corner support member to form the blank into a partially formed container;

at least one compression member carried in spaced relation to the partially formed container;

a fixed plate carried in spaced relation to the at least one compression member, the fixed plate and the at least one compression member forming a passage therebetween; and a second folding arm positioned for biasing against the outside corner support member, wherein the fixed plate is positioned for contacting an outer edge of the outside corner support member and guiding at least a portion of the outside corner support member along the surface of the fixed plate through the passage to a position where the outer edge of the outside corner support member is substantially perpendicular to the at least one bottom panel of the container.

17. A machine according to claim 16, wherein the outside corner support member includes at least a top wall portion, a first fold portion, and a second fold portion.

18. A machine according to claim 17, wherein the first folding arm is configured to fold the top wall portion and the first fold portion of the outside corner support member to a position that is substantially parallel to the at least one bottom panel.

19. A machine according to claim 17, wherein the fixed plate is positioned to contact an outer edge of at least one of the first fold portion and the second fold portion, and guide at least one of the first fold portion and the second fold portion along the surface of the fixed plate through the passage to a position substantially perpendicular to the at least one bottom panel of the container.

20. A machine according to claim 17, wherein the first fold portion is positioned adjacent to a first side panel of a first set of the two sets of opposing side panels such that the first fold portion and the first side panel form a first side wall.

21. A machine according to claim 17, wherein the second fold portion is positioned adjacent to a second side panel of a second set of the two sets of opposing side panels such that the second fold portion and the second side panel form a second side wall.

22. A machine for forming a container from a blank of sheet material, the blank including at least one bottom panel, a first set of opposing side panels, a second set of opposing side panels, and an outside corner support member, wherein the outside corner support member includes at least a top wall portion, a first fold portion coupled to the top wall portion, and a second fold portion coupled to the first fold portion, the machine comprising:

a platen for moving the blank from a first position to a second position downstream therefrom;

a first folding arm movably positioned for folding at least the top wall portion of the outside corner support member to form the blank into a partially formed container;

at least one compression member carried in spaced relation to the partially formed container;

a fixed plate carried in spaced relation to the at least one compression member, the fixed plate and the at least one compression member forming a passage therebetween; and a second folding arm positioned for biasing against the outside corner support member, wherein the fixed plate is positioned for contacting an outer edge of the first fold portion and guiding the first fold portion through the passage, wherein the second folding arm, the fixed plate, and the at least one compression member work together to position the first fold portion and the second fold portion in a squared-off corner structure.

* * * * *